US007428763B2

(12) United States Patent
Hightower

(10) Patent No.: US 7,428,763 B2
(45) Date of Patent: Sep. 30, 2008

(54) UNIVERSAL, MULTIPURPOSE PILLOW USED FOR BEAUTY AND/OR HEALTH PURPOSES

(76) Inventor: Anthony Hightower, 200 Kennedy Dr., Reno, NV (US) 89506

( * ) Notice: Subject to any disclaimer, the term of this patent is extended or adjusted under 35 U.S.C. 154(b) by 0 days.

(21) Appl. No.: 11/503,626

(22) Filed: Aug. 14, 2006

(65) Prior Publication Data

US 2008/0034503 A1 Feb. 14, 2008

(51) Int. Cl.
*A47G 9/10* (2006.01)

(52) U.S. Cl. ..... 5/636; 5/640; 5/639; 5/904; 5/925; 5/926

(58) Field of Classification Search ..... 5/636, 5/640, 637, 639, 490, 904, 925, 926; 2/410, 2/421, 425, 209.13, DIG. 10, DIG. 11
See application file for complete search history.

(56) References Cited

U.S. PATENT DOCUMENTS 1,514,516 A * 11/1924 Golomb ..... 2/9
1,517,886 A * 12/1924 Austin ..... 2/9
1,759,738 A * 5/1930 Erario ..... 2/9
1,859,313 A * 5/1932 Pereles ..... 2/425
1,887,636 A * 11/1932 Hamby ..... 2/425
2,277,994 A * 3/1942 Roberts ..... 2/421
2,458,025 A * 1/1949 Portal ..... 2/421
2,533,526 A * 12/1950 Snyder ..... 606/204.35
2,546,842 A * 3/1951 Yealdhall ..... 2/425
2,696,007 A * 12/1954 Larkin et al. ..... 2/171
2,768,380 A * 10/1956 Golomb ..... 2/420
2,886,818 A * 5/1959 Roberts ..... 2/421
2,898,596 A * 8/1959 Keen ..... 2/421
3,087,166 A * 4/1963 Howard ..... 2/420
3,171,133 A * 3/1965 Steffen ..... 2/414
3,311,921 A * 4/1967 Helm ..... 2/421
3,327,316 A * 6/1967 Pukish, Jr. ..... 2/421
3,513,482 A * 5/1970 Holden ..... 2/421
3,596,288 A * 8/1971 Marchello ..... 2/421
3,628,191 A * 12/1971 Douglas ..... 2/421
3,820,780 A * 6/1974 Tarbox ..... 482/10
4,279,037 A * 7/1981 Morgan ..... 2/421
4,550,458 A * 11/1985 Fiore ..... 5/637
4,551,861 A * 11/1985 Marchello ..... 2/425
4,617,691 A * 10/1986 Monti et al. ..... 5/640
4,646,728 A * 3/1987 Takeda ..... 128/97.1
4,663,785 A * 5/1987 Comparetto ..... 2/413
4,679,263 A * 7/1987 Honer ..... 5/640
4,710,985 A * 12/1987 Dubner et al. ..... 2/425
4,821,345 A * 4/1989 Marchello ..... 2/425
4,982,451 A * 1/1991 Graham ..... 2/410
5,094,229 A * 3/1992 Pomatto et al. ..... 602/17

(Continued)

FOREIGN PATENT DOCUMENTS

WO WO 8704614 A1 * 8/1987

*Primary Examiner*—Robert G Santos

(57) ABSTRACT

A pillow specifically used for eliminating any physical contact between a specific delicate skin area of a users body part, a support surface, and the pillow, thus completely eliminating any possible contact between the specific delicate skin area and any associated object. For example, the specific delicate skin area may be the face of the user, the users body part being their head and the support surface being a bed. The pillow is so structured as to be removably, adjustably, and comfortably worn and attached onto any part of the users body and may also be made from numerous materials of choice.

11 Claims, 1 Drawing Sheet

U.S. PATENT DOCUMENTS 5,228,143 A * 7/1993 Marchello ..... 2/425
5,378,042 A * 1/1995 Daneshvar ..... 297/393
5,400,440 A * 3/1995 Clifford ..... 2/172
5,441,479 A * 8/1995 Chitwood ..... 602/18
5,454,781 A * 10/1995 Chitwood ..... 602/18
5,465,441 A * 11/1995 Chun ..... 5/653
5,504,945 A * 4/1996 Purnell ..... 2/425
5,505,523 A * 4/1996 Wang ..... 297/393
5,685,021 A * 11/1997 Tsujino ..... 2/425
5,709,649 A * 1/1998 Chitwood ..... 602/32
5,881,393 A * 3/1999 Marchello ..... 2/425
6,058,516 A * 5/2000 Purnell ..... 2/425
6,418,565 B1 * 7/2002 Tsujino ..... 2/425
6,427,253 B1 * 8/2002 Penny ..... 2/412
6,564,395 B2 * 5/2003 Keen ..... 2/425
6,641,221 B1 * 11/2003 Kastlunger ..... 297/397
6,651,256 B1 * 11/2003 Swift ..... 2/171
6,732,381 B1 * 5/2004 Lal ..... 2/425
6,782,558 B1 * 8/2004 Keen et al. ..... 2/425
2002/0002733 A1 * 1/2002 Keen ..... 2/425
2003/0106137 A1 * 6/2003 Penny ..... 2/412
2005/0193477 A1 * 9/2005 Penny ..... 2/411
2008/0010727 A1 * 1/2008 Keen ..... 2/425
2008/0034503 A1 * 2/2008 Hightower ..... 5/636

* cited by examiner

UNIVERSAL, MULTIPURPOSE PILLOW USED FOR BEAUTY AND/OR HEALTH PURPOSES

FIELD OF THE INVENTION

The present invention relates in general to pillows such as those used while sleeping but more particularly pertains to a pillow specifically used for eliminating any physical contact between a specific delicate skin area of a users body part, a support surface, and the pillow, thus completely eliminating any possible contact between the specific delicate skin area and any associated object. For example, the specific delicate skin area may be the face of the user, the users body part being their head and the support surface being a bed. The pillow is so structured as to be removably, adjustably, and comfortably worn and attached onto any part of the users body and may also be made from numerous materials of choice.

BACKGROUND OF THE INVENTION

Within the known prior art numerous attempts have been made and proposed to provide a pillow that is not only comfortable but is also designed to be functional for a specific purpose and/or use. Some examples include the following prior art.

U.S. Pat. No. 6,651,256 entitled "WEARABLE PILLOW" is in the form of a helmet and is used to eliminate exposure to any light and also reduce any noise that may be disturbing to the sleeper.

U.S. Pat. No. 6,003,177 entitled "PILLOW" is designed to alleviate symptoms associated with sleep apnea such as snoring and typical breathing problems resulting there from.

U.S. Pat. No. 5,054,143 entitled "ANTI-WRINKLE PILLOW" is designed to reduce contact between the facial skin and the pillow.

Each of the noted references are somewhat functional for the intended use but none are functional for completely eliminating any contact between the support surface or the pillow and a specific delicate skin area of a user body part as taught by the present invention. Even, the U.S. Pat. No. 5,054,143 is not functional for this purpose as while sleeping people tend to toss and turn. Whereby a sleeper using the pillow as illustrated therein would need to continuously remain on their side and consciously keep the pillow in a special position. Clearly, this reference is not functional especially if a sleeper wishes to sleep on their tummy. This is very unlike the present pillow that undoubtedly teaches a pillow that protects the face from contacting any surface no matter what position the sleeper assumes.

Still other types of pillows exist each of which are designed for a specific purpose. However, each reference has inherent numerous disadvantages and problems. Importantly, they are simply not universal for eliminating all of the problems associated with prior art pillows. The present pillow clearly recognizes, addresses and resolves each problem in a new and novel manner as will be seen within the following specification.

OBJECTS AND ADVANTAGES OF THE PRESENT INVENTION

It is therefore a primary object of the present invention to provide a pillow that can be easily adjusted, attached and/or worn by a user for the purpose of eliminating any possible contact between a specified delicate skin area, the pillow itself and/or the support surface.

It is another object of the present invention to provide a pillow that is extremely comfortable and reduces sleeplessness typically associated with standard types of pillows, due to tossing and turning while trying to find a comfortable position.

Yet another important object of the present invention is to provide a pillow that is especially useful for beauty purposes. For example, if used on a person's head, the delicate and sensitive surface of the facial skin never contacts any surface. Therefore, the unsightly "morning-wrinkles" and "creases" caused there from are completely avoided. Thus resulting is a "wrinkle-free" good nights sleep. More importantly, if used over time greatly reduces and/or may completely eliminate age-lines associated therewith. Also, very importantly when worn on the head due to the construction of the pillow, the head and neck are supported in natural alignment. Thus, further relieving neck problems, pain and stiffness upon arising commonly associated with other pillows.

Still another object of the present invention is to provide a pillow that is functional for use with beauty aids. For example, if one uses beauty creams, acne medication, or any type of facial product the pillow will not allow for the product to be rubbed off or transferred to the pillow or bed. As a result, the products intended use is enhanced resulting in an additional bonus. Furthermore, facial blemishes and/or acne may be greatly reduced due to this pillow, as most pillows tend to absorb grime, sweat, drool, etc, all of which are contributing factors to un-healthy skin disorders.

Yet another object of the present invention is to provide a pillow that is functional as a health aid for therapeutic purposes. For example, many individuals have a need for elevating of a limb or like when resting. Such as one who has had an injury to a knee, an elbow, leg, etc, whereby, elevating the limb while resting relieves stress and/or pain associated therewith. Another example wherein the pillow is orthopedic includes individuals having carpal tunnel syndrome, or the like. For example, it has been suggested that a carpal tunnel victim often causes further injury because they tend to position their wrist/arm under a pillow and this can reduce circulation to the wrist and elbow area. Thus, the present invention can be utilized independently with the outward side of the wrist being positioned within the pillow and the inside of the wrist being positioned within the specialized area of the pillow. As a result, the inside of the wrist is protected from contact with the pillow or bed and the user can rest their head on the outwardly protruding ends of the pillow. Alternatively, the user may combine a conventional pillow if needed, thus still achieving the desired end result of protecting the inside of the wrist from any compression while resting.

Still another object and advantage of the present pillow is that it may be used for protecting a surgical site, a scrape, a sore, blister etc. For example, in many cases (such as with a finger wound) it may be desirable to expose the wound to fresh air to expedite the natural healing process. As a result, the present pillow can be easily positioned about a portion of the finger and the wound can be positioned within the special space provided by the pillow. Whereby, the wound is protected from contact with any object but is still exposed to the air for improved natural healing thereof.

Yet another object and advantage of the present invention is to provide a pillow (such as when worn on the users head while sleeping) that helps to reduce undesirable sounds that may interfere with sleeping and awake the user. For example, due to the novel and unique structure of the pillow, the users ears are comfortably cushioned and covered by the pillow, therefore resulting in a protective ear muffle.

A further very important object and advantage of the present invention is to provide a pillow that may be easily produced in a large variety of sizes. For example, the pillow may be of a shape and size that can easily fit a users finger, leg, ankle, toe, or even any part of the torso. Also, the pillow may be sold independently with a specific use in mind, such as a pillow that is worn only on the head for sleeping. Or the pillow can be produced as a multipurpose kit having numerous pillows therewith each of which are designed for a specific use. However, even though they may be designed for a specific use, each pillow is still completely adjustable for various sized users.

Yet another very important object and advantage of the present invention is to provide a pillow that may be made from numerous materials of engineering choice. For example, the pillow can be made as one unitary member from any suitable soft pliable fabric of choice. Or if preferred, the pillow can be formed from interconnecting portions with the exterior surface of the pillow being made from a silky soft material that may easily slide upon a surface, such as a bed, while the interior portion is made from a non-slip material of choice so as to eliminate slippage and accidental release of the pillow while sleeping, or the like. It is to be noted that it may be advantageous to make the pillow from hypoallergenic fabric/material as well. Also, as an option the pillow may be used in combination with a slipcover that can be easily slipped onto/over the pillow. Thus, if so desired the slipcover can be removed for washing purposes (if made from a washable material) and/or it may be disposed of (if made from disposable material) and replaced periodically, depending on the material of user and/or engineering choice.

Yet another, optional manufacturing choice is to include a pillow that may be formed from a plastic material that may be inflated with air so as to allow for adjusting the firmness thereof. Still a further option is to fill the plastic pillow with a fluid such as water or gel, etc., which also allows for varying the firmness to an individuals liking as well as provides variable temperature control.

Still another object of the present invention is to provide a pillow that may be used as an icepack. For example, if the pillow is made from plastic material forming a hollow bag respectively, and includes a fill means such as a fill hole and stopper, the bag can be filled with a water and rubbing alcohol mixer and then frozen until needed. In this scenario it is to be noted that such a mixture, water/alcohol, when frozen turns into a slush thus resulting in a perfect icepack as it is cold yet pliable and molds itself to the surface to which it is applied.

Yet another object of the present invention is to provide a pillow that if made as an inflatable pillow it can function as a float that is wearable by a swimmer to provide buoyancy while in the water.

Also a further object and advantage of the present invention is to provide a pillow that may be manufactured with any suitable type of fastening means of engineering choice. For example, the pillow may be formed as one unitary member having an elastic adjustment means therein so as to allow for the pillow to be easily slipped onto the body part and slidably engaged thereon. Or any other suitable fastening means may be incorporated, such as loop and pile, namely VELCRO™ straps, or straps with a buckle, buttons, snaps, or the like.

Still another object or advantage is to provide a pillow that may include optional features of choice. For example, it may be desirable to include electronic options. For example, a small compartment may be provided within the pillow for containment of a musical device such as an IPOD™, an MP3™ player, a palm pilot, cell phone, or the like. Whereby, a user has the option of listening to relaxing music or any other sounds of their choice.

Yet another object and advantage of the present invention is to provide a pillow that is portable for ease while traveling or the like. For example, if one is traveling by either auto, train, or airplane the pillow can be used upon a support surface such as a window. Also another important advantage of the present pillow is that it is most convenient for use with infants, such as when they are in a "car seat", a crib, etc.

Still another object and advantage of the present invention is to provide a pillow that is extremely comfortable, easy to use, economical to manufacture, and is easy to package and sell.

Other objects and advantages will become apparent when taken into consideration with the following specification and drawings.

DETAILED DESCRIPTION OF THE DRAWINGS

Figure 1:
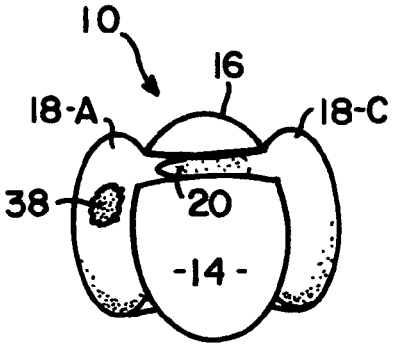
FIG. 1 is substantially a front view of the preferred embodiment for the present invention when attached onto an object of choice.
Figure 2:
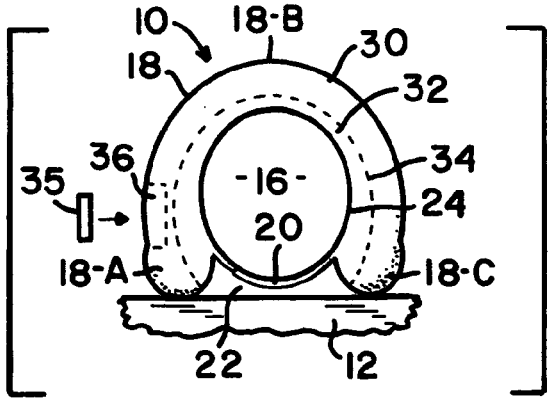
FIG. 2 is substantially a top view of FIG. 1 further including an exemplary support surface.

Referring now in detail to the drawings wherein like characters refer to like elements throughout the various views. As illustrated within FIGS. 1& 2, (10) represents an overview for the preferred embodiment for the present pillow. The pillow (10) is a multipurpose pillow that may be used for either beauty or health purposes and when combined with a support surface (12) such as a bed or the like, eliminates any contact between the support surface (12) and a specific delicate skin area (14) of a users body part (16). It is to be understood the pillow (10) can be used for any body part that has a specific delicate skin area that is to be protected from contact with anything. Thus, the body part (16) can be a users face, a finger, leg, ankle, toe, or any part of the users torso, etc.

For exemplary purposes, the present pillow (10) is exceptionally useful and most advantageous when used on a person's body part (16), namely their head. Whereby, the delicate and sensitive surface (14) of the facial skin never contacts any surface. Therefore, the unsightly "morning-wrinkles" and "creases" caused there from are completely avoided. Thus resulting is a "wrinkle-free" good nights sleep. More importantly, if used over time greatly reduces and/or may completely eliminate age-lines associated therewith. Additionally, due to the construction of the pillow (10) when worn on the users head, the pillow is very useful for noise reduction as the pillow (10) functions as a protective ear muffle.

The pillow (10) is also most advantageous when used in combination with beauty aids. For example, if one uses beauty creams, acne medication, or any type of facial product the pillow (10) will not allow for the product to be rubbed off or transferred to the pillow (10) or the support surface (12) such as the bed. As a result, the products intended use is enhanced resulting in an additional bonus. Furthermore, facial blemishes and/or acne may be greatly reduced due to this pillow (10), as most pillows tend to absorb grime, sweat, drool, etc, all of which are contributing factors to un-healthy skin disorders.

The general construction for the preferred embodiment for the pillow (10) includes a unitary member (18) having a first end section (18-A), an intermediate section (18-B) and a second end section (18-C). As can be seen within FIGS. 1 & 2, each end section (18-A and 18-B) are spaced apart and opposed to each other yet removably, adjustably interconnected by an adjustment means (20). As a result, each end section (18-A and 18-B) is distanced outwardly from the adjustment means (20), thus forming an open space (22) between each end section (18-A and 18-B) and the adjustment means (20). Furthermore, due to this construction the intermediate section (18-B) with the adjustment means (20) in combination form a centralized opening (24) for receiving a portion of a users body part (16) there through. The portion of a users body part (16) has a specified delicate skin area (14), thus when the portion of the users body part (16) is positioned into and through the centralized opening (24) with the specified delicate skin area (14) being positioned within the open space (22), the intermediate section (18-B) wraps around in a mating relationship with the portion of said users body part (16). Therefore, each end section (18-A & 18-C) in combination with the open space (22), eliminate any possible contact between the support surface (12), the pillow (10) and/or the specific delicate skin area (14) thus providing the new and unusual advantageous results heretofore not achieved.

It is to be clearly understood the adjustment means (20) may be any suitable type of fastening means of engineering choice that is variable in length for variably adjusting the distance between each end section (18-A & 18-B). For example, the pillow (10) may be formed as one unitary member (18) having an elastic adjustment means therein so as to allow for the pillow to be easily slipped onto the body part (16) and slidably engaged thereon. Or any other suitable fastening means may be incorporated, such as loop and pile, namely VELCRO™ straps, or straps with a buckle, buttons, snaps, or the like. Therefore, the invention is not to be limited to any specific type of fastener.

It can now be seen the pillow (10) of the present invention can be used for purpose of user choice, such as the pillow can be functional as a beauty aid, a therapeutic aid, used for an ear muffle for noise reduction, and/or used as a travel pillow, etc.

It is to be noted the above pillow as described is functional as is but if so desired additional accessory options maybe included. For example, in FIG. 3, the pillow may further include an optional slipcover (26) that may be slidably engaged onto pillow (10). The slipcover (26) can be made from any suitable material of engineering and/or end user choice. Another alternative is that the noted pillow (10) and/or the slipcover (26) can be made from any hypoallergenic fabric/material of choice. Still further the slipcover may be made from either a disposable material or a washable re-usable material.

Figure 3:
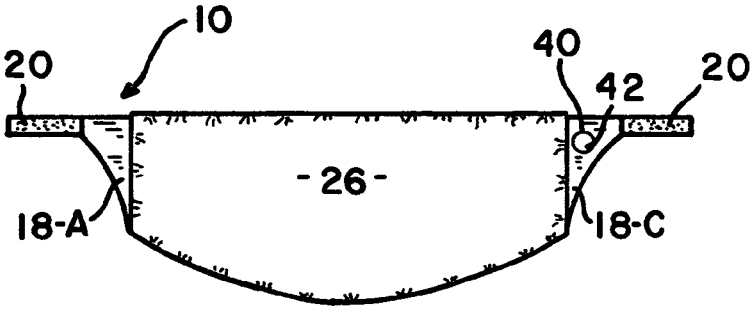
FIG. 3 is substantially a front view of the pillow when in an open position and also includes an optional slipcover thereon.
Figure 4:
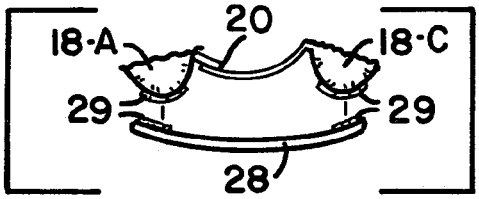
FIG. 4 is substantially a top view of a removably attached eyeshade that is an optional feature.

A further option as depicted in FIG. 3, includes a pillow made from plastic and is hollow forming an internal cavity having a fill means. For example, pillow (10) can include a fill hole (40) that is in open communication with the internal cavity and a closure means such as stopper (42). Whereby, the cavity of pillow (10) can be filled with a water/rubbing-alcohol mixture and stored within a freezer until needed for use as an icepack. Yet another optional feature for the present pillow is to include (if desired) an eyeshade (28) for blocking light while sleeping. The eyeshade (28) maybe fixedly attached and/or removably attached by a suitable fastener means of choice. For example, the eyeshade may include VELCRO™ strips that are attached onto each end section (18-A & 18-C) and allow for variable adjustment thereof. It is to be noted the eyeshade (28) when fastened is spaced outwardly from the attachment means (20) so as to only shade the eyes and does not contact any portion of the face of the user. Again, the eyeshade maybe made from any suitable material of choice.

With further regard to the construction of the pillow (10) if so desired the pillow may be formed from an exterior portion (30) and an interconnected internal portion (32). Each portion (30 & 32) maybe fixedly attached by any suitable attachment means of choice such as glue, a zipper, etc., or as depicted herein stitching (34) is most functional. The exterior portion (30) of the pillow being made from a silky soft material that may easily slide upon a surface, such as a bed, while the interior portion is made from a non-slip material of choice so as to eliminate slippage and accidental release of the pillow while sleeping, or the like.

Still another optional feature for the present pillow (10) is to include a storage compartment (36) for containment of any device of user choice. For example, the user may wish to position a musical device (35) such as an IPOD™, an MP3™ player, a palm pilot, cell phone, or the like. Whereby, a user has the option of listening to relaxing music or any other sounds of their choice. Although not shown it is to be noted the storage compartment (36) includes suitable open/closure means of choice.

Furthermore, it is to be clearly understood the pillow (10) is further filled with a pliable resilient cushioning substance (38) of engineering and/or end user preference. For example, the cushioning substance maybe simply cotton, foam, padding, etc. However, yet another optional manufacturing choice is to include a pillow (10) that may be formed from a plastic material that may be inflated with air so as to allow for adjusting the firmness thereof. Or if preferred the plastic pillow (10) maybe filled via fill hole (40) and stopper (42) with a pliable resilient cushioning substance (38) in the form of a fluid such as water or gel, etc., which also allows for varying the firmness to an individuals liking as well as provides variable temperature control, for example, the water or gel maybe warm or cold. It can now be seen we have herein provided a new and novel pillow that is universal, functions for multiple purposes, is either useful for beauty and/or therapeutic use, is cost effective and most importantly eliminates any possible contact between the support surface (such as a bed), the pillow and a specific delicate skin area of a user. It can now further be seen that we have herein provided a pillow that is useable for any body part of a user. Also, as previously noted the pillow can be produced as a complete kit having numerous sized pillows therein and/or sold separately.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

What I claim as new and wish to secure by Letters Patent is:

1. A universal, multipurpose pillow used for beauty or health purposes which when used in combination with a support surface eliminates any contact between the support surface or the pillow and the delicate sensitive surface of the facial skin, said pillow comprising: a unitary member having a first end section; an intermediate section having substantially a linear top edge with a convex lower edge of a greater thickness; and a second end section; each said end section being spaced apart forming a pair of convex portions that are opposed to each other yet interconnected by an adjustment means, said pair of convex portions extend laterally forwardly from said adjustment means, thus forming an open space between each said end section and said adjustment means, said intermediate section with said adjustment means in combination form a centralized opening for receiving the head of the user there through, said head of the user having a specified delicate skin area, said specified delicate skin area being the delicate sensitive surface of the facial skin of said user, thus when said head of said user is positioned through said centralized opening with said delicate sensitive surface of the facial skin being positioned within said open space, said unitary member is formed from an exterior portion and an interconnected internal portion, said exterior portion is made from a silky soft material that will easily slide upon said support surface and said internal portion is made from a non-slip material that eliminates slippage and accidental release of said pillow, said intermediate section wraps around in a mating relationship with said head of the user and each said end section in combination with said open space eliminate any possible contact between said support surface or said pillow and said delicate sensitive surface of the facial skin no matter what position the sleeper assumes.

2. The pillow of claim 1 wherein said unitary member is further filled with a pliable resilient cushioning substance.

3. The pillow of claim 1 wherein said adjustment means is further variable in length for variably adjusting the distance between each said end section.

4. The pillow of claim 1 includes an optional slipcover made from a washable material.

5. The pillow of claim 1 includes as an optional storage compartment for containment of a radio, or an electrical device sold under the Trademark of iPod, MP3 or PalmPilot.

6. The pillow of claim 1 is functional as a beauty aid as it eliminates wrinkles and creases of said delicate sensitive surface of the facial skin, said pillow is also usable with beauty creams, acne medication, or any type of facial product as said pillow will not allow said product to be rubbed off or transferred to said pillow or said support surface.

7. The pillow of claim 1 is functional as a therapeutic aid as it protects said delicate sensitive surface of the facial skin and cushions surrounding tissues.

8. The pillow of claim 1 is functional for noise reduction.

9. The pillow of claim 1 is functional for a travel pillow.

10. The pillow of claim 1 is produced in a variety of sizes so as to comfortably fit different sizes of said user.

11. The pillow of claim 1 includes an eyeshade as an optional feature for blocking light, said eyeshade when fastened is spaced outwardly from said attachment means so as to only shade the eyes and does not contact any portion of the face of said user.

* * * * *